United States Patent [19]

Walker

[11] Patent Number: 4,563,970

[45] Date of Patent: Jan. 14, 1986

[54] SAIL WITH RETRACTABLE AIR DIRECTING ELEMENT

[76] Inventor: John G. Walker, 7 Kingfisher Close, Hamble, Hampshire, England

[21] Appl. No.: 500,951

[22] Filed: Jun. 3, 1983

[30] Foreign Application Priority Data

Jun. 4, 1982 [GB] United Kingdom ..... 8216269

[51] Int. Cl.[4] ..... B63H 9/06

[52] U.S. Cl. ..... 114/103; 114/102; 244/215; 244/216

[58] Field of Search ..... 114/39, 102, 103, 104; 244/215, 216, 217

[56] References Cited

U.S. PATENT DOCUMENTS

| | | | |
|---|---|---|---|
| 1,661,114 | 2/1923 | Flettner | 114/163 |
| 2,257,215 | 9/1941 | Zap | 244/215 |
| 2,836,380 | 5/1958 | Pearson | 244/216 |
| 3,528,632 | 9/1970 | Miles | 244/215 |
| 3,853,289 | 12/1974 | Nevermann | 244/215 |
| 3,934,533 | 1/1976 | Wainwright | 244/216 |

FOREIGN PATENT DOCUMENTS

| | | | |
|---|---|---|---|
| 403416 | 9/1924 | Fed. Rep. of Germany . | |
| 177576 | 6/1982 | Japan | 114/103 |
| 43118 | 9/1982 | Japan | 114/103 |
| 198649 | 5/1924 | United Kingdom . | |
| 568209 | 3/1945 | United Kingdom | 114/103 |

OTHER PUBLICATIONS

Sail Magazine, Dec. 1978, "U.S. Wins War of Wings", pp. 45–50.

*Primary Examiner*—Trygve M. Blix
*Assistant Examiner*—Thomas J. Brahan
*Attorney, Agent, or Firm*—Roylance, Abrams, Berdo & Goodman

[57] ABSTRACT

A sailset comprising a leading aerofoil and a trailing aerofoil that pivots about an axis passing through the leading aerofoil. A third comparatively small aerofoil is retractable within the leading aerofoil and extendable downwind of the trailing edge of the leading aerofoil to provide a surface overlapping the leading edge of the trailing aerofoil.

Guides for the third aerofoil are preferably provided for both its leading and trailing edges, the guides comprising roller and roller tracks and/or sliding pivots.

6 Claims, 9 Drawing Figures

SAIL WITH RETRACTABLE AIR DIRECTING ELEMENT

This invention relates to sails for marine or terrestrial vessels and especially to aerofoil wing type sails.

European Patent Application No. 82301255.2, filed on Mar. 17, 1982, describes a wing type sail comprising two main sail elements, both of rigid symmetrical aerofoil section, which are mounted one downstream of the other, the trailing sail element being pivotally mounted to the leading sail element so that the trailing element can be pivoted about an upright axis to either side of the centre line of the leading element. A third comparatively smaller aerofoil element is pivoted to the trailing edge of the leading element and extends downwind to form a smooth extension of the leeward surface of the leading element and to direct air over the leeward surface of the trailing element. This third air directing element, or slat, is pivoted from one side of the trailing element to the other side when the tack is changed and, for a given spacing between the leading and trailing elements, the chord length for the third air directing element is limited to that length which can be pivoted past the leading edge of the trailing element without interference. In the above-mentioned application the length of the air directing element is maximised by effecting the repositioning of the air directing element from one side of the trailing element to the other when the trailing element is at a position of maximum deflection, at which point the spacing between the leading and trailing elements is at its maximum.

The present invention is directed towards providing an air directing element, the chord length and positioning of which may be independent of the spacing between the leading and trailing elements, thus enabling a greater chord length and/or simple change of tack.

Accordingly the present invention provides a sailset comprising a leading sail element and an air directing element that is retractable towards and extendable downwind of the leading element.

Retraction and extension of the air directing element is preferably linked to movement of a trailing sail element incorporated in the sailset.

In a preferred embodiment of the invention the elements each comprise rigid aerofoils and the trailing edge of the leading element is provided with hinged portions that are resiliently biased to progressively open and close as the air directing element is extended from and retracted within the leading element. Guides are preferably provided for both the leading and trailing edges of the air directing element; these guides may comprise sliding pivots or rollers and roller tracks.

The invention will now be described by way of example with reference to the accompanying drawings in which.

Figure 1:
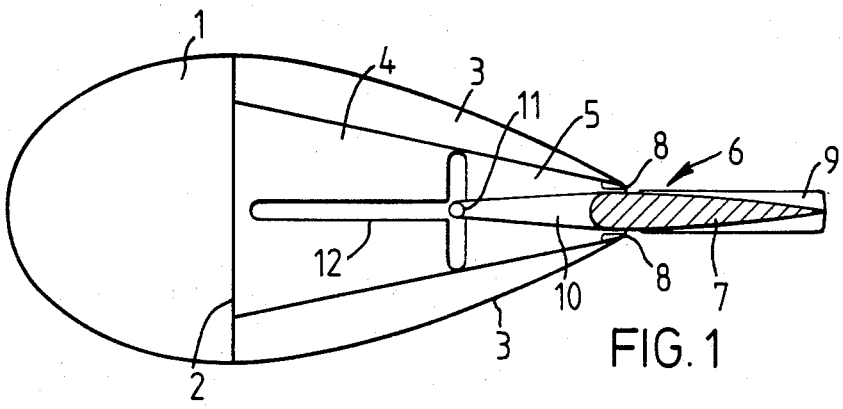
FIG. 1 is a schematic cross-sectional view, taken perpendicular to the span, of a leading sail element and air directing slat assembly according to an embodiment of the invention.

Referring to FIG. 1 of the drawings, a leading sail element 1 of rigid symmetrical aerofoil section has a main spar 2 and flank elements 3 which define an approximately triangular section cell 4 which extends spanwise of the leading sail element. This triangular section cell 4 is subdivided in the spanwise direction by part-ribs 5, also of approximately triangular configuration, which serve to aid the rigidity of the sail element 1. The apex of the triangular section cell 4 (or each sub-division thereof) is open and defines a slot 6 extending spanwise of the sail element 1: thus it will be seen that the leading sail element 1 has twin trailing edges separated by the slot 6.

An air directing element in the form of a slat 7 is mounted in the slot 6 in such a way that the slat 7 may be retracted into the triangular cell 4, or extended (as shown in FIG. 1) so that the leading edge of the slat 7 is positioned between the trailing edges of the leading element 1. The trailing edges of the leading element 1 are provided with guides 8 which engage with raised substantially parallel portions 9 provided on the slat 7 and enable the slat to be smoothly retracted with the parallel portions running along the guides. Guides 8 and parallel portions 9 are conveniently provided at each end of the span of the sailset, and may also be provided at intermediate spanwise locations. The width of the raised portions 9 corresponds approximately to the maximum width of the slat 7, which occurs near to the relatively blunt or rounded leading edge of the slat. Apart from at the raised portions, the trailing edge of the slat is relatively sharp.

The slat 7 is also provided with arms 10 which extend from the leading edge of the slat, the arms 10 terminating in pins 11 which run in T-shaped guide grooves 12. An arm 10 and groove 12 arrangement may be located at each end of the span, or arm and groove arrangements may be provided at several spaced apart spanwise locations.

Figure 2:
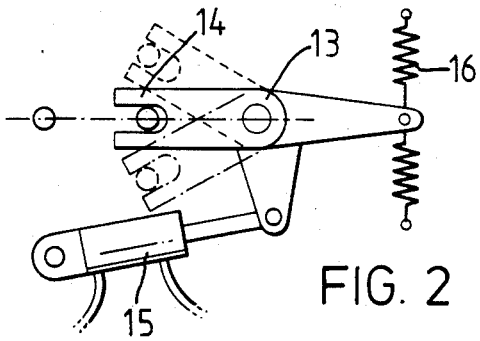
FIG. 2 shows a mechanism for deflecting the air directing slat of FIG. 1.

Movement of the slat 7 is effected by moving the pins 11 in the T-shaped grooves 12. FIG. 2 shows a mechanism for movement of the pins 11 along the crosspiece of the T-shaped groove, which leads to lateral movement of the slat 7. The mechanism comprises a crank 13, one arm of which terminates in a fork 14 that engages a pin 11. An actuator 15, such as a fluid operated cylinder, is connected to the crank 13 and when operated urges the pin 11 along the groove 12, the forked part 14 of crank 13 taking up one of the positions shown in dotted outline in FIG. 2, or some intermediate position, depending on the extent and direction of operation of actuator 15. A spring 16 urges the crank 13 back towards its central position when the action of the actuator 15 is relaxed, although the crank could alternatively be driven back to its central position by the actuator 15. As the crank 13 moves pin 11 in the cross-piece of the T-groove 12, the arm 10 connected to the pin is moved and causes the slat 7 to pivot about a spanwise axis passing approximately in line with the slot 6 and the leading edge of the slat 7 and to adopt a deflected position, the extent and direction of the deflection depending on the position of pins 11.

Figure 3:
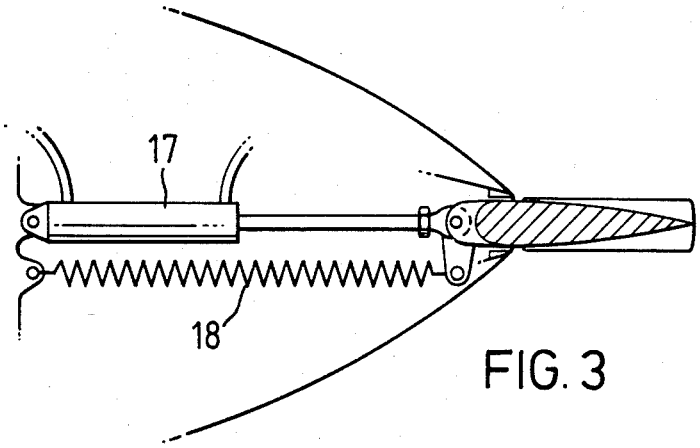
FIG. 3 shows a mechanism for retracting the air directing slat of FIG. 2.

FIG. 3 shows a mechanism for movement of the pins 11 longitudinally of the T-shaped groove 12, which leads to retraction and extension of the slat 7 into and out from the leading sail element 1. In this mechanism a second actuator 17 operates by extending to urge pin 11 along the "upright" of the T-shaped groove 12, against the bias of restoring spring 18, and thus engage pin 11 in the forked part 14 of crank 13. In order to engage the pin 11 in the forked part 14 the crank 13 must be centralized, and so the actuators 15 and 17 are controlled so that actuator 15 is relaxed (or driven to its central position) when actuator 17 is retracted, and only when actuator 17 has fully extended can actuator 15 operate to deflect the now extended slat 7. Likewise, in order to retract the slat 7, the crank 13 must first be centralised.

Although the actuators 15 and 17 may be driven, respectively, to their central and retracted positions, thus rendering springs 16 and 18 optional, it is preferable to have restoring springs 16 and 18 present so that in the event of loss of power for positioning the slat 7, the slat is first centralised and then retracted.

Actuators 15 and 17 are shown as fluid operated cylinders, however it is envisaged that wires, motors or other drive mechanisms could be used instead.

Figure 4:
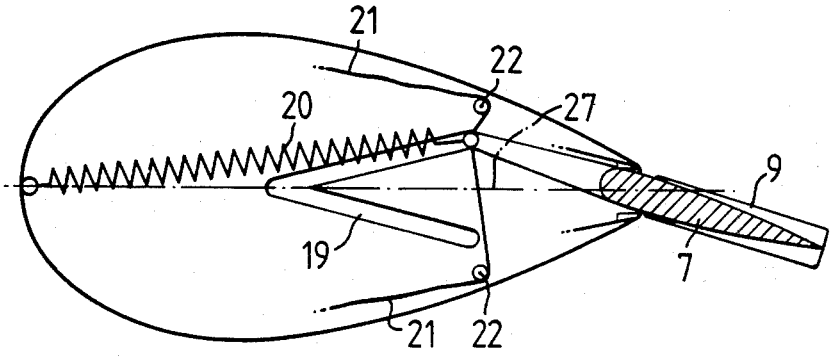
FIG. 4 is a schematic cross-sectional view, taken perpendicular to the span, of an alternative embodiment of deflection and retraction mechanism.
Figure 5:
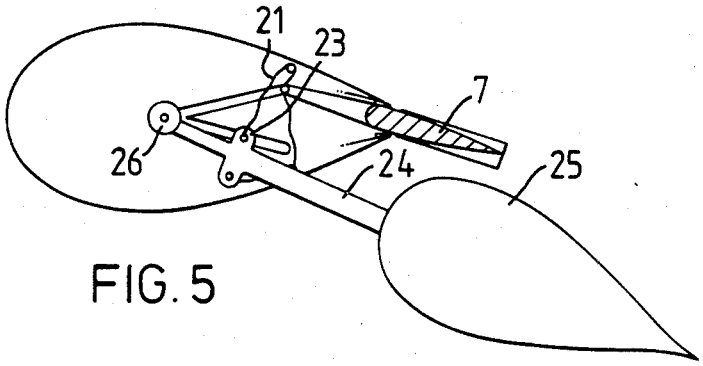
FIG. 5 is a schematic cross-sectional view of the embodiment of FIG. 4, including a trailing sail element.

FIGS. 4 and 5 show an alternative embodiment in which the V-shaped grooves 19 replace the T-shaped grooves 12 and a spring 20 provides a restoring force that can urge the pin 11 from the deflected position shown to a central, retracted position at the apex of the groove 19. Wires 21 are connected to the pin 11, pass over sheaves 22 and are connected to lugs 23 on a hinge arm 24 that extends from the leading edge of the trailing element 25 of the sailset. The position of the lugs 23 and the route of the wires 21 is such that deflection of the trailing element 25 controls the extension and deflection of the slat 7. FIG. 5 shows the trailing element 25 fully deflected and the slat 7 fully extended and fully deflected. Movement of the trailing element 25 about its pivot axis 26 towards a position of alignment with the leading sail element 1 allows the spring 20 to retract the slat 7 until the pin 11 reaches the apex of the groove 19. At this point the slat 7 is fully retracted and does not interfere with the further movement of the trailing element 25 to the other side of the centre line 27 of leading element 1. As the trailing element continues to deflect further to the other side of the centre line 27, the slat 7 is once more progressively extended and deflected to finally reach a mirror image configuration to that of FIG. 5 as the pins 11 traverse the other arm of the grooves 19.

Figure 6:
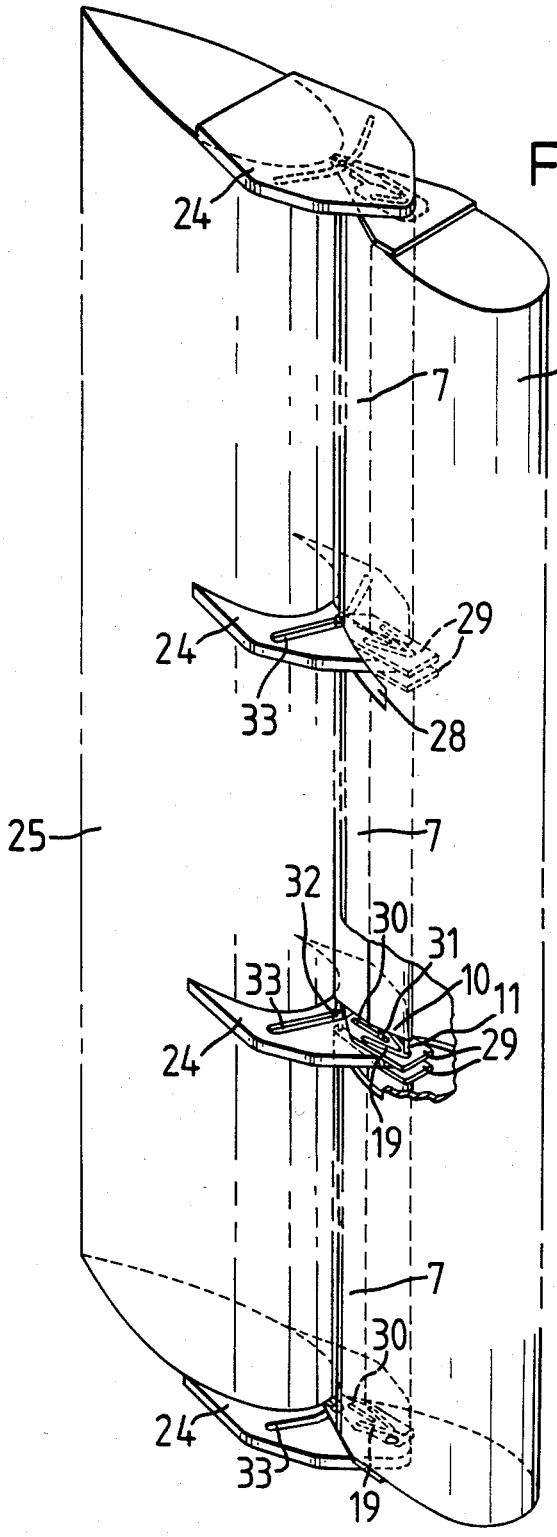
FIG. 6 is a perspective view of a sailset including a further modification of the invention.

Referring now to FIGS. 6 to 9, a further modification of the invention is shown. This modification employs a V-shaped groove for guiding the slat, but also provides additional guidance for the trailing edge of the slat and a refinement to the trailing edge of the leading sail element. FIG. 6 illustrates this modification on a sailset that has three spanwise portions, each spanwise portion corresponding to a part of the span between adjacent pairs of hinge arms 24. The leading sail element 1 and the trailing sail element 25 may be constructed each to have three separate spanwise portions which are linked to move in unison or, as shown, the leading and trailing sail elements may each be formed as a single unit with the hinge arms 24 joined to the external surface of the trailing element 25 and the leading sail element 1 having cutaway portions 28 for the front part of the hinge arm. Within the leading sail element there are mounting plates to which respective ones of the hinge arms are pivoted; all the pivots for the arms 24 are aligned to give an overall hinge axis that is within the leading element. The slat 7 is divided into three separate spanwise portions in order to permit unhindered movement of the hinge arms 24, each portion of the slat being mounted between a pair of hinge arms 24 and having arms 10 at its upper and lower end. In this modification the upper and lower arm portions 10 of each slat portion may be joined (as shown in FIG. 6) and be formed effectively as an extension to leading edge of the slat portion 7.

Figure 7:
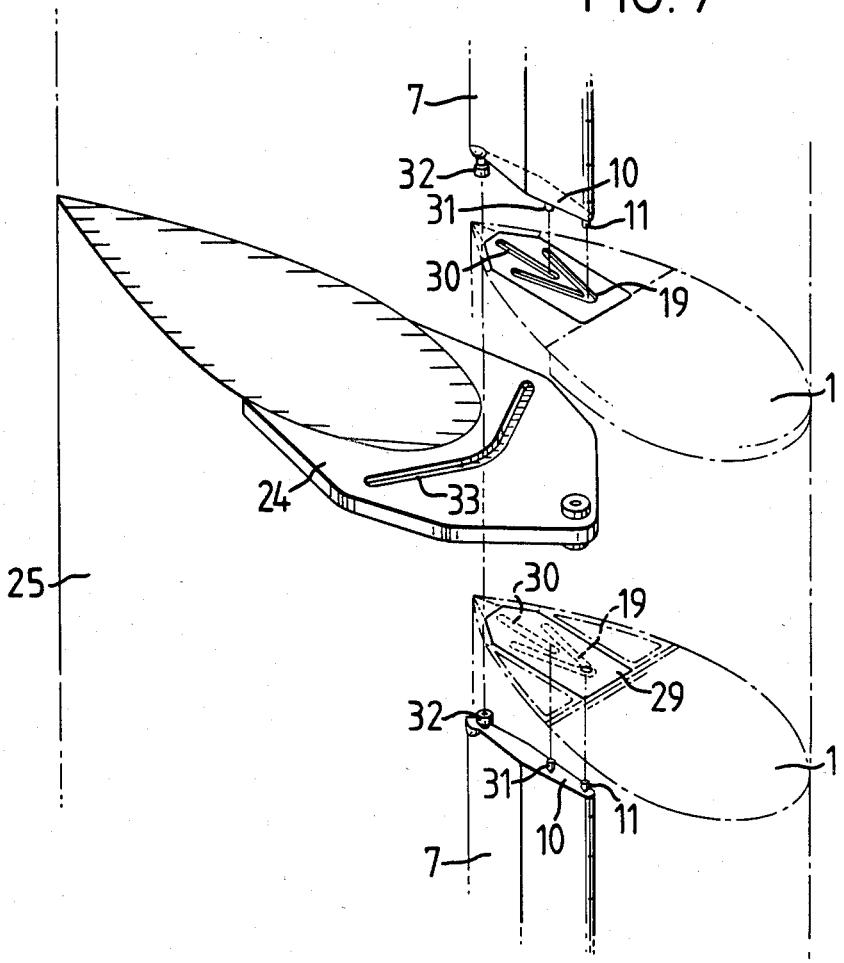
FIG. 7 is an exploded view of a part of the sailset shown in FIG. 6.

FIG. 7 shows in an exploded view the stacking sequence of the slat retraction elements above and below one of the mid-span hinge arms. The upper and lower hinge arms each have a single set of slat retraction elements adjacent them, while the two mid-span hinge arms have a mirror image configuration of retraction elements above and below them. Adjacent the mounting for the hinge arm 24, there are cam plates 29 into which V-shaped grooves are cut. These cam plates, as can more easily be seen from FIGS. 8 and 9, also have a straight groove 30. The V-shaped grooves 19 and the straight grooves 30 are engaged by pins 11 and 31 which extend from the front and rear ends of the arm 10 of the slat 7.

It can be seen that there is one portion of slat 7 above hinge arm 24 and another portion below hinge arm 24, with a cam plate 29 interposed between arm 24 and the arm 10 of each of the slat sections. The slat portions may be linked together to ensure unison of motion, or this may be achieved by the simultaneous operation of extension and retraction means together with slat guidance means.

A further refinement of this modification of the invention is that the trailing edge of the slat 7 is provided with rollers 32 that roll in guide tracks 33 on the hinge arms 24. There may be a single roller and track arrangement for each portion of slat 7, or more preferably a roller and track arrangement is provided at each end of each slat portion. Thus the midspan hinge arms have a guide track 33 on their upper and lower surfaces, and the end hinge arms each have only one guide track on the respective surface adjacent the slat portion.

Figure 8:
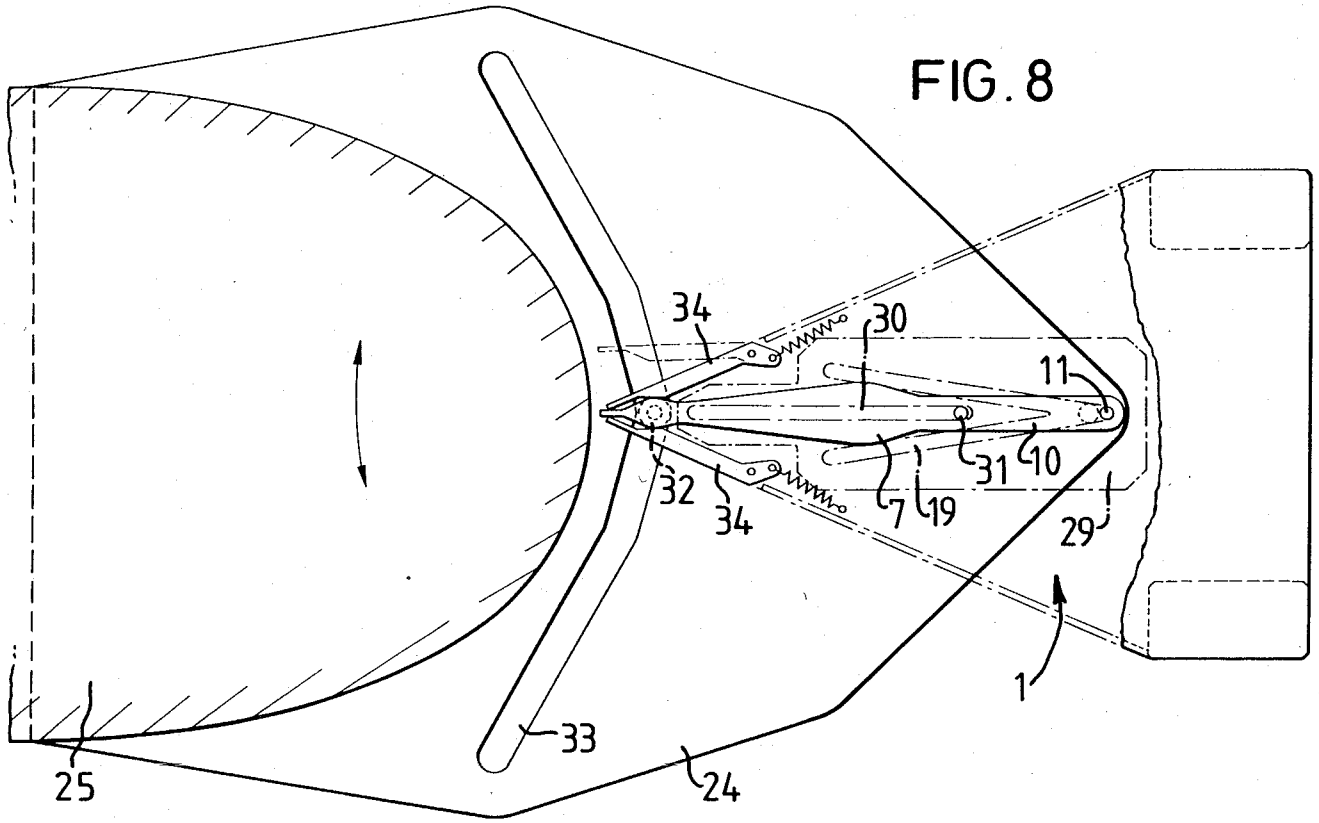
FIG. 8 is a plan view of the modification of FIG. 6 with the air directing slat partly retracted.

Further detail of this modification of the invention is now described with reference to FIGS. 8 and 9, which show respectively plan views with the slat 7 in a fully retracted and a fully extended configuration. Guidance of the slat 7 is achieved by way of a threefold mechanism comprising the V-shaped groove 19 in conjunction with the pin 11 mounted at the front end of the arm 10 that extends from the leading edge of the slat 7, the straight groove 30 in conjunction with the pin 31 mounted at the rear end of the arm 10, and the roller 32 in conjunction with guide track 33. The V-shaped groove 19 and pin 11 operate similarly to the arrangement described with respect to FIGS. 4 and 5, and the straight groove 30 and pin 31 provide central guidance for the slat as it is extended and retracted, keeping the leading edge of the slat 7 in line with the groove 30 which is itself aligned with the centre line of the leading sail element. In this respect the straight groove 30 and pin 31 provide a function similar to that of the guides 8 and parallel portions 9 described in conjunction with FIG. 1. The guide track 33 and roller 32 may serve as just a guide for the trailing edge of the slat and an aid to rigidity, or it may comprise part of the extension and retraction mechanism for the slat 7 so that when the trailing section 25 is pivoted away from the central aligned position the engagement of the roller in the guide track 33 transmits a component of force to extend the slat 7, and in a similar manner to retract the slat 7 as the trailing section is pivoted back into central alignment. In this latter instance the roller and guide track may be toothed.

As the central guidance for the slat 7 is provided by the straight groove 30 and pin 31, it is not necessary to provide parallel portions on the slat or guides for these portions on the trailing edge of the leading sail element 1. This enables the trailing edge of the leading element 1 to be provided with hinged portions 34 which close over the slat 7 when it is retracted and swing open against a spring bias when the slat 7 is extended.

Figure 9:
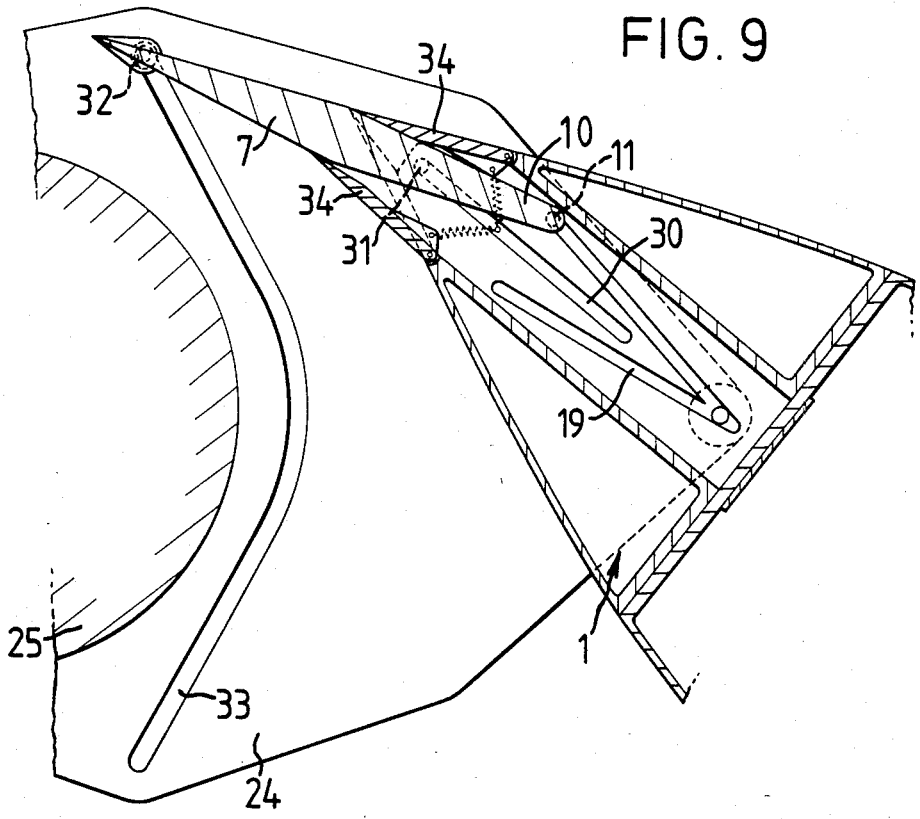
FIG. 9 is a plan view of the modification of FIG. 6 with the air directing slat fully extended.

Referring now to FIG. 9, it can be seen that when the trailing element 25 is deflected to its full extent and the slat 7 is fully extended the pins 11 and 31 have slid to the respective extreme left (as viewed) positions of the grooves 19 and 30 and the roller 32 has moved along from the centre to one end of track 31. A mirror image configuration can be adopted for sailing on the opposite tack with the pin 11 engaging the end of the (as viewed) leftmost lower limb of the V-shaped groove and the slat 7 on the other (i.e. lower as viewed) side of the trailing section 25. In this extended position of the slat 7, the hinged portions 34 of the leading section have swung away from their symmetrical position about the centre line, the lower (as viewed) hinged portion opening by a greater angle than the upper hinge portion. Both the hinged portions 34 maintain contact at their tips with the slat 7 to give a smooth surface.

The apex angle of the V-shaped groove and the path of the track 33 are designed to optimise the spacing between the trailing edge of the slat and the leading edge of the tail section when the tail section is at maximum deflection.

It is envisaged that the pins 11 and 31 and the grooves 19 and 30 could be replaced by other means for guiding the slat 7, such as a roller and roller track arrangement. Similarly the roller and roller track arrangement for the trailing edge of the slat could be replaced by other guide means such as a pin and guide groove or slot arrangement, or by a pair of rollers embracing a ridge.

The embodiments described incorporate symmetrical aerofoils which are capable of being positioned in mirror image configurations with respect to the centre line as it is envisaged that for most practical purposes such symmetry, leading to equal facility in port and starboard tacking, will be preferred. As the slat 7 can be retracted when the trailing element is pivoted past the trailing edge of the leading element, the trailing element may be mounted close to the leading element without risk of interference with the slat. Also the slat chord length may be chosen to give optimum slot configuration without the imposition of a maximum chord length determined by the spacing between the leading and trailing sail elements.

The rigid aerofoils described may be made of glass fibre material or plastics and the various parts bonded together.

I claim:

1. A sail assembly comprising:

(a) a first upright rigid symmetrical aerofoil;

(b) a second upright rigid symmetrical aerofoil disposed closely behind the first aerofoil;

(c) means for mounting the second aerofoil for pivoting movement about an upright axis relative to said first aerofoil from an aligned position wherein the second aerofoil is aligned with the first aerofoil to positions angularly displaced from said aligned position and on each side thereof;

(d) an air-directing slat disposed at the trailing portion of the first aerofoil; and (e) means for retracting the slat within the first aerofoil to allow the second aerofoil to pass through the said aligned position and for extending the slat outwardly and rearwardly of said first aerofoil to overlap the second aerofoil when said second aerofoil is angularly displaced from the said aligned position, said means for retracting and extending said slat including means for coupling said pivoting movement of said second aerofoil to the retraction and extension of said slat.

2. A sail assembly according to claim 1 wherein said means for retracting and extending said slat includes a V-shaped guide means and means for coupling said slat to the guide means to pivot said slat towards the second aerofoil as said slat is extended rearwardly of said first aerofoil.

3. A sail assembly comprising:

(a) a first rigid symmetrical aerofoil;

(b) a second rigid symmetrical aerofoil;

(c) means for mounting said second aerofoil closely behind the first aerofoil and for pivoting movement relative to said first aerofoil to positions angularly displaced from a central position wherein said second aerofoil is substantially coplanar with said first aerofoil;

(d) an air-directing slat disposed at a trailing portion of said first aerofoil;

(e) means operable in accordance with said pivoting movement of said second aerofoil for retracting said slat within said first aerofoil and for extending said slat outwardly and rearwardly of said first aerofoil to overlap said second aerofoil; and (f) means for pivoting said slat towards the second aerofoil as said slat is extended to overlap said second aerofoil.

4. A sail assembly comprising:

(a) a first upright rigid aerofoil;

(b) a second upright rigid aerofoil;

(c) means for mounting said second aerofoil closely behind said first aerofoil and for pivoting said second aerofoil about an upright axis from a position substantially coplanar with said first aerofoil to positions angularly displaced from said first aerofoil;

(d) an air-directing slat disposed at the trailing portion of the first aerofoil so as to be capable of forming an aerodynamic slot with said second aerofoil;

(e) means operable in accordance with said pivoting of said second aerofoil for retracting the slat to allow the second aerofoil to pivot through said coplanar position and for extending the slat to overlap said second aerofoil to form said aerodynamic slot.

5. A sail assembly according to claim 4 wherein said first aerofoil includes flap means extending from each side of the first aerofoil to the slat to form a substantially continuous connecting surface between each said side and said slat.

6. In a marine sailing vessel having a sailing rig comprising first and second upright rigid aerofoils of which the second is disposed closely behind the first and is mounted for pivoting movement relative thereto, and including an air directing member disposed at the trailing portion of the first aerofoil for forming an aerodynamic slot with said second aerofoil, the improvement which comprises:

(i) means for retracting and extending said member relative to the said trailing portion; and (ii) means coupled to the second aerofoil for operating the said means for retracting and extending in response to said pivoting movement of said second aerofoil.

* * * * *